US005351110A

United States Patent [19]

Saito et al.

[11] Patent Number: 5,351,110

[45] Date of Patent: Sep. 27, 1994

[54] IMAGE FORMING APPARATUS ADAPTED FOR REVERSAL DEVELOPING PROCESS WHICH IS DIMINISHED IN OZONE AND NITROGEN OXIDE EMISSIONS

[75] Inventors: Hitoshi Saito, Machida; Katsutoshi Konishi, Toyono, both of Japan

[73] Assignee: Minolta Camera Kabushiki Kaisha, Osaka, Japan

[21] Appl. No.: 101,955

[22] Filed: Aug. 4, 1993

Related U.S. Application Data

[63] Continuation of Ser. No. 869,534, Apr. 15, 1992, abandoned.

[30] Foreign Application Priority Data

Apr. 19, 1991 [JP] Japan ..... 3-088533

[51] Int. Cl.[5] ..... G03G 15/02

[52] U.S. Cl. ..... 355/221; 355/219; 355/225

[58] Field of Search ..... 355/208, 216, 219, 221, 355/223, 225

[56] References Cited

U.S. PATENT DOCUMENTS

| | | | |
|---|---|---|---|
| 4,272,183 | 6/1981 | Maese et al. | 355/219 |
| 4,591,262 | 5/1986 | Oseto et al. | 355/221 |
| 4,761,671 | 8/1988 | Sadowski et al. | 355/296 |
| 4,772,914 | 9/1988 | Kinashita et al. | 355/200 |
| 4,811,045 | 3/1989 | Matsushita et al. | 355/219 |
| 4,916,491 | 4/1990 | Katoh | 355/219 X |
| 5,032,870 | 7/1991 | Yui et al. | 355/219 |
| 5,049,935 | 9/1991 | Saito et al. | 355/219 |
| 5,132,738 | 7/1992 | Nakamura et al. | 355/219 X |

*Primary Examiner*—Fred L. Braun

*Attorney, Agent, or Firm*—Willian Brinks Hofer Gilson & Lione

[57] ABSTRACT

An image forming apparatus which has a sensitizing charger for charging an image bearing member to a first polarity, a developing device and a transfer charger for imparting to the image bearing member a charge having a second polarity opposite to the first polarity to transfer the toner image from the image bearing member onto a sheet. In the apparatus, the transfer charger is turned off after a rear end of the image area of the image bearing member where a latent image is formed has moved past the transfer charger. Subsequently, the sensitizing charger is turned off after the rear end of the image area has moved past the sensitizing charger. Thereafter, the image bearing member is stopped a predetermined period of time after the sensitizing charger is turned off.

8 Claims, 7 Drawing Sheets

IMAGE FORMING APPARATUS ADAPTED FOR REVERSAL DEVELOPING PROCESS WHICH IS DIMINISHED IN OZONE AND NITROGEN OXIDE EMISSIONS

This application is a continuation, of application Ser. No. 07/869,534, filed Apr. 15, 1992, now abandoned.

BACKGROUND OF THE INVENTION

1. Field of the Invention

The present invention relates to image forming apparatus adapted for the reversal developing process.

2. Description of the Prior Art

Conventional image forming apparatus, such as laser beam printers, which are adapted to practice the reversal developing process comprise a photosensitive member rotatably provided centrally thereof, and a sensitizing charger, developing roller, transfer charger, cleaner and eraser lamp which are successively arranged around the photosensitive member along the direction of rotation thereof. These components of the conventional image forming apparatus are controlled with the timing illustrated in FIG. 1. When the main motor is turned on first, the photosensitive member starts rotation, and the developing roller, sensitizing charger and eraser lamp are turned on at the same time. Subsequently, the transfer charger is turned on with predetermined timing. The rear end of an electrostatic latent image thereafter passes through the transfer position, whereupon the transfer charger is turned off. When a sheet is completely discharged from the apparatus next, the main motor is stopped, and the developing roller, eraser lamp and sensitizing charger are turned off at the same time.

With the image forming apparatus described, corona discharge of the sensitizing and transfer chargers produces ozone ($O_3$) and nitrogen oxides ($NO_x$), which will act on talc, kaoline or like component contained in paper particles deposited from the sheet onto the surface of the photosensitive member to reduce the sensitivity of the photosensitive member at the portion thereof where the paper particles are deposited. Consequently, the surface potential of the particle bearing portion will not fully drop when exposed to a laser beam.

In the case where the potential thus fails to drop sufficiently owing to a reduction in the sensitivity of the photosensitive member, the following problem arises. When the surface of the photosensitive member as uniformly charged to a predetermined potential V0 is irradiated with the laser beam, the surface potential of the irradiated portion usually decreases to a potential Vi lower than the developing bias VB as indicated in a solid line in FIG. 2 to form an electrostatic latent image. Toner adheres to the portion lower than the developing bias VB in potential to form a toner image. However, if the portion of reduced sensitivity is irradiated with the laser beam, the surface potential of this portion decreases only to a potential Vj which is higher than the developing bias VB as indicated in a broken line in FIG. 2, with the result that no toner adheres to the portion to create a fault in the image. Such a fault occurs regardless of whether a plurality of images are produced continually or intermittently, whereas the fault becomes more pronounced if the length of time after the completion of one image until the formation of the next image is shorter.

This problem will be overcome by turning off the sources of ozone and nitrogen oxides, i.e., the sensitizing charger and the transfer charger, immediately after the rear end of the electrostatic latent image has moved past the transfer charger. On the other hand, the surface of the photosensitive member moving past the transfer charger before the transfer charger is turned off is subjected by this charger to corona discharge opposite in polarity to the corona discharge of the sensitizing charger and has its potential reduced to a level lower than the developing bias VB. Further with usual image forming apparatus, the main motor continues rotation to rotate the photosensitive member a plurality turns until the sheet is completely discharged from the apparatus after the latent image rear end has moved past the transfer charger. Accordingly, in the case where the sensitizing charger and the transfer charger are simultaneously turned off immediately after the latent image rear end has moved past the transfer charger, the portion of the photosensitive member, having its potential reduced by moving past the transfer charger immediately before the transfer charger is turned off and retaining the reduced potential, passes by the developing roller of the reversal developing unit. The toner then adheres to this portion and becomes wasted uselessly.

SUMMARY OF THE INVENTION

The main object of the present invention is to provide an image forming apparatus which is adapted for the reversal development of electrostatic latent images and diminished in ozone and nitrogen oxide emissions to preclude faults in the images.

Another object of the invention is to provide an image forming apparatus which is operable without consuming the toner uselessly.

These and other objects of the invention are fulfilled by an image forming apparatus which comprises a drivingly rotatable image bearing member, means for charging the image bearing member to a first polarity, means for forming an electrostatic latent image on the charged image bearing member, means for developing the electrostatic latent image with a toner by reversal development, charge erasing means for imparting to the image bearing member a charge having a second polarity opposite to the first polarity to transfer the toner image from the image bearing member onto a sheet, and control means for turning off the charge erasing means after the rear end of the electrostatic latent image has moved past the charge erasing means, subsequently turning off the charging means after the latent image rear end has moved past the charging means and stopping the rotation of the image bearing member a predetermined period of time after the charging means is turned off.

The above and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
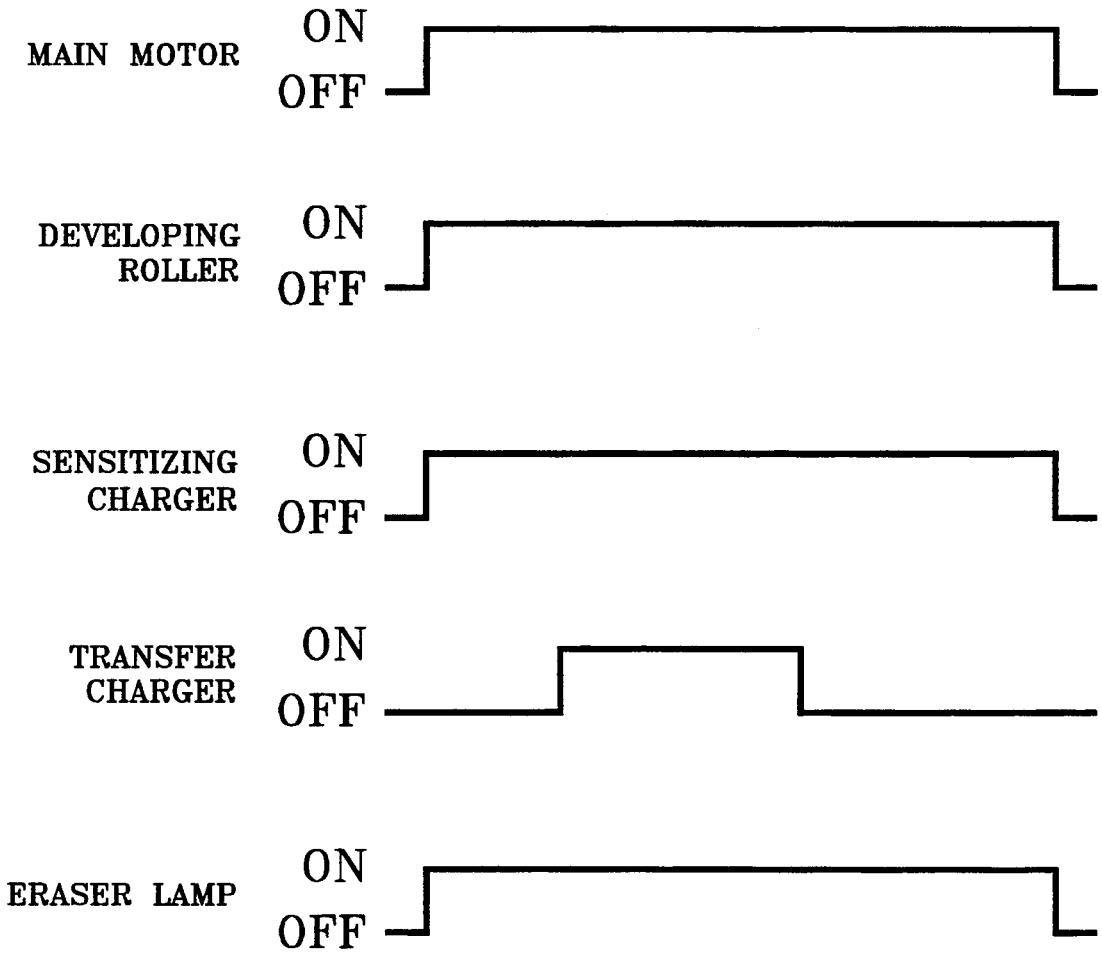
Fig. 1 PRIOR ART
FIG. 1 is a timing chart showing the timing with which components of a conventional image forming apparatus are controlled.
Figure 2:
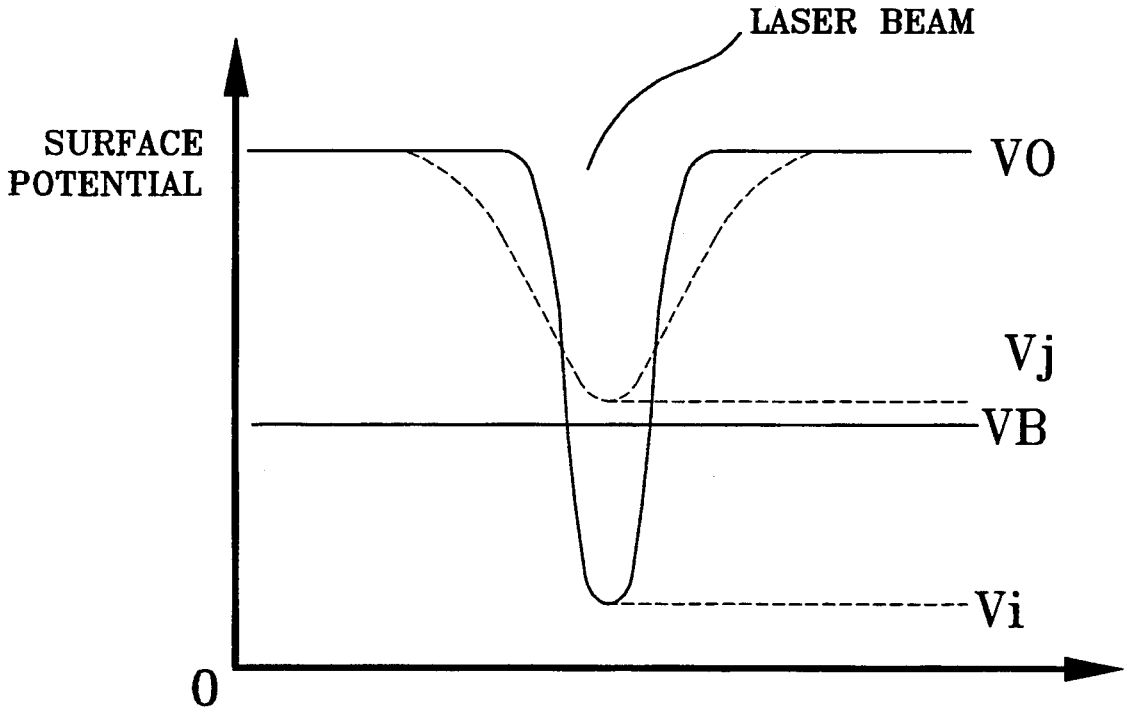
FIG. 2 is a diagram showing a variation in the surface potential of a uniformly charged photosensitive member when the member is irradiated with a laser beam.
Figure 3:
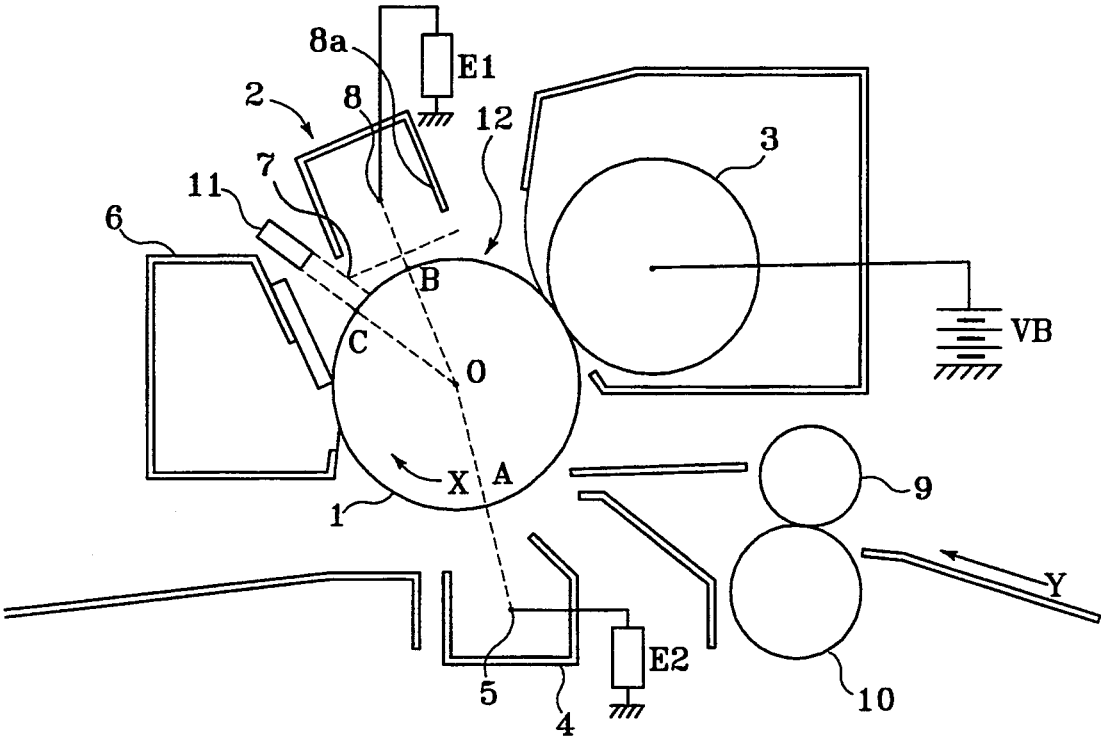
FIG. 3 is a view in section schematically showing a laser beam printer embodying the invention.

A first embodiment of the invention will be described first with reference to FIGS. 3 to 5. FIG. 3 is a sectional view schematically showing the embodiment, i.e., a laser beam printer.

A photosensitive drum 1 is so supported as to be rotatable by a main motor (not shown) in the direction of arrow X and is formed over the peripheral surface thereof with an organic photosensitive layer having such dark decay characteristics that the initial charge potential attenuates by up to about 20% for 10 seconds. Successively arranged around the drum 1 are a sensitizing charger 2, developing roller 3, transfer charger 4, cleaning blade 6 and eraser lamp 11. The laser beam printer has an unillustrated laser optical system for projecting a laser beam 12 onto the photosensitive drum 1 at a position between the sensitizing charger 2 and the developing roller 3.

The sensitizing charger 2 has a wire electrode 8 for effecting corona discharge with a voltage applied thereto by a high-voltage power source E1, a shield plate 8*a* provided around the electrode 8 and a grid 7 connected to an unillustrated constant-voltage element. When the electrode 8 starts corona discharge, the grid 7 is maintained at a predetermined potential by the constant-voltage element, whereby the surface of the drum 1 is charged to a substantially uniform potential. The developing roller 3 retains thereon a developer containing a toner which is charged to the same polarity as the corona discharge of the sensitizing charger 2. With the rotation of the developing roller 3, the developer comes into brushing contact with the surface of the drum. The developing roller 3 has developing bias VB applied thereto, and the toner adheres to the surface portion of the drum 1 which has a potential lower than the developing bias VB. The transfer charger 4 comprises a wire electrode 5 which has a high-voltage power source E2 connected thereto and to which a voltage opposite in polarity to the sensitizing charger 2 is applied. The cleaning blade 6 is in pressing contact with the photosensitive drum 1 for scraping off the toner adhering to the drum surface. Timing rollers 9, 10 are pressed against each other to nip a sheet sent forward in the direction of arrow Y and feed the sheet to a transfer position between the drum 1 and the transfer charger 4 in synchronism with the rotation of the drum 1.

Figure 4:
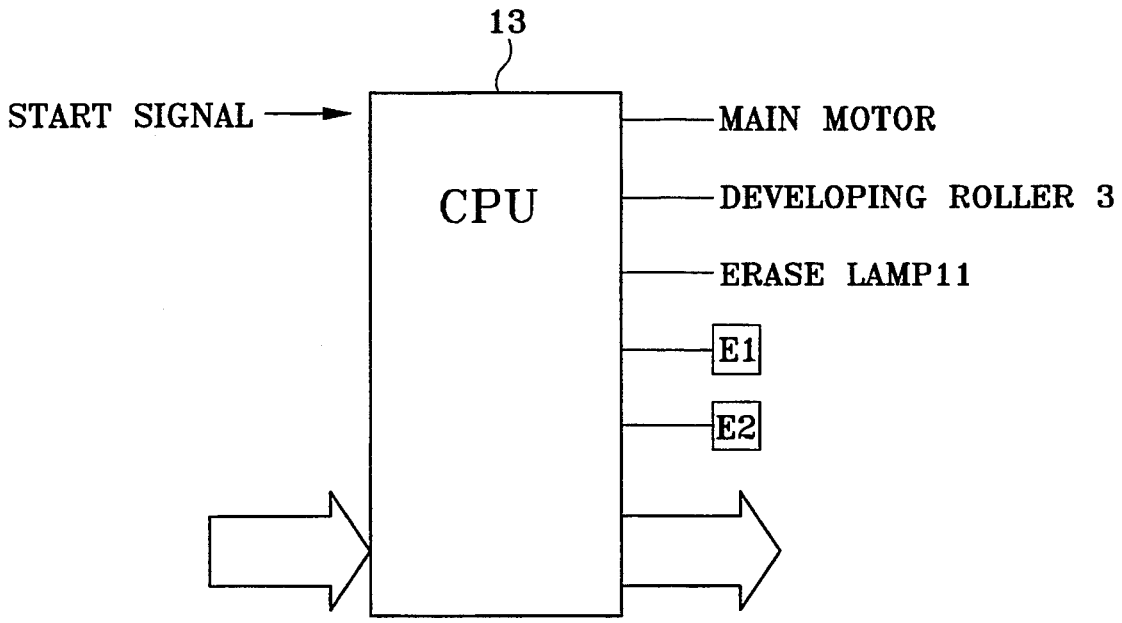
FIG. 4 is a block diagram of a control circuit for controlling the laser beam printer.
Figure 5:
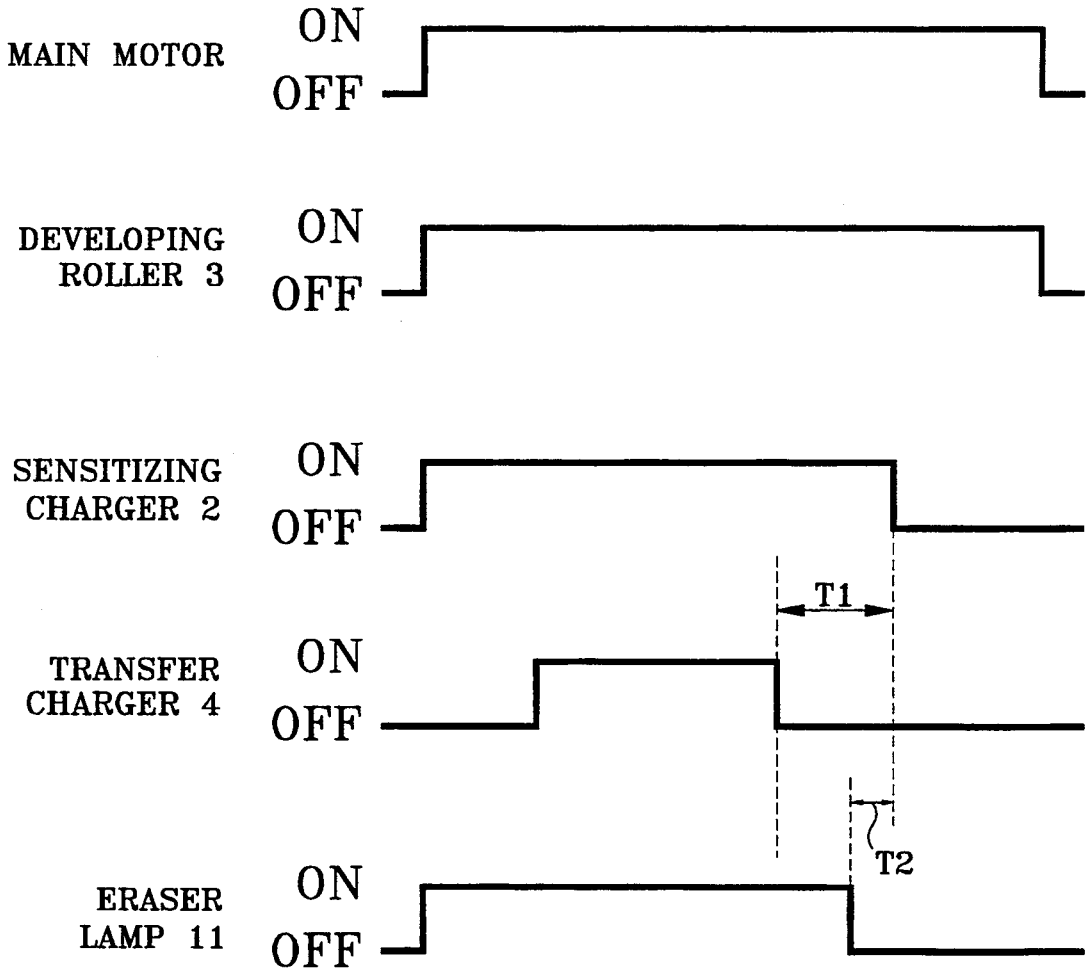
FIG. 5 is a timing chart showing the timing with which a sensitizing charger, transfer charger and eraser lamp are controlled.

FIG. 4 is a block diagram of a control circuit for controlling the image forming operation of the laser beam printer.

A CPU 13 has an input port for receiving a start signal commanding the start of image formation from an external device to which the laser beam printer is connected. The CPU 13 has output ports connected to the main motor, developing roller 3, eraser lamp 11 and high-voltage power sources E1, E2.

Next, one cycle of image forming operation to be performed by the laser beam printer of the above construction will be described with reference to the timing chart of FIG. 5.

First, the start signal commanding the start of image formation is fed to the CPU 13, whereupon the CPU 13 delivers signals for operating the main motor, developing roller 3, high-voltage power source E1 and eraser lamp 11, whereby the photosensitive drum 1, sensitizing charger 2, developing roller 3 and eraser lamp 11 are initiated into operation. When the drum 1 charged by the sensitizing charger 2 is irradiated with a laser beam 12 corresponding to image data, the surface potential of the irradiated portion drops to a level lower than the developing bias VB, forming a negative electrostatic latent image. The developer then comes into contact with the latent image, permitting the toner to electrostatically adhere to the image portion of the latent image (i.e., the portion having the potential power than the developing bias VB) to form a toner image. Further when the leading end of the surface area of the drum 1 where the latent image is formed (hereinafter referred to as the "image area") reaches a position opposed to the transfer charger 4, the CPU 13 feeds a signal to the high-voltage power source E2 to operate the transfer charger 4. Consequently, the toner image is subjected through a sheet to corona discharge from the electrode 5 and transferred onto the sheet. Since the polarity of the transfer charger 4 is opposite to that of the sensitizing charger 2, the surface potential of the drum 1 drops uniformly at this time with the charge remaining thereon neutralized. The toner remaining on the drum 1 without being transferred to the sheet is thereafter scraped off by the cleaning blade 6. The photosensitive drum 1 is further irradiated with light by the eraser lamp 11, has its surface potential thereby lowered temporarily, is then charged by the sensitizing charger 2 again and rotates to the developing position again while retaining a high surface potential.

On the other hand, the high-voltage power source E2 for the transfer charger 4 is turned off upon the rear end of the image area moving past a position (point A) opposed to the electrode 5. Further the high-voltage power source E1 for the sensitizing charger 2 is turned off a period of time T1 after the power source E2 is turned off which period is required for the image area rear end to move from the point A to a position (point B) opposed to the electrode 8 of the charger 2. On the other hand, the eraser lamp 11 is turned off more than a period of time T2 before the power source E1 is turned off which period is required for the image area rear end to move from the upstream end (point C) of the region irradiated with the lamp 11 to the point B. Thus, the eraser lamp 11 is turned off before a length of time T1–T2 elapses from the time power source E2 is turned off.

The surface area of the drum 1 where the electrostatic latent image is not formed (hereinafter referred to as the "nonimage area") moves past the position (point A) of the transfer charger 4 after this charger 4 is turned off, and reaches the irradiation region (point C) of the eraser lamp 11 the length of time T1–T2 after moving past the point A while retaining a high potential. When the nonimage area reaches the point C, the eraser lamp 11 is already off, so that the surface potential of the nonimage area does not drop. The nonimage area further reaches the position (point B) of the sensitizing charger 2 upon lapse of the period of time T2. Since the charger 2 is already off, the nonimage area is not subjected to the corona discharge at this time, nor has it been charged to the opposite polarity by the transfer charger 4 or exposed to the light from the eraser lamp 11, with the result that the area retains the high surface potential. The drum 1 further rotates to bring the nonimage area to the position of the developing roller 3, whereas the decrease in the potential is slight during the period of about one turn of rotation of the drum 1 following the charging by the sensitizing charger 2. Even when reaching the position opposed to the developing roller 3, the nonimage area therefore still retains a high potential and does not permit deposition of the toner thereon despite contact with the developer on the developing roller 3. The operation of the roller 3 and the main motor is thereafter discontinued to complete one cycle of image forming operation.

Figure 6:
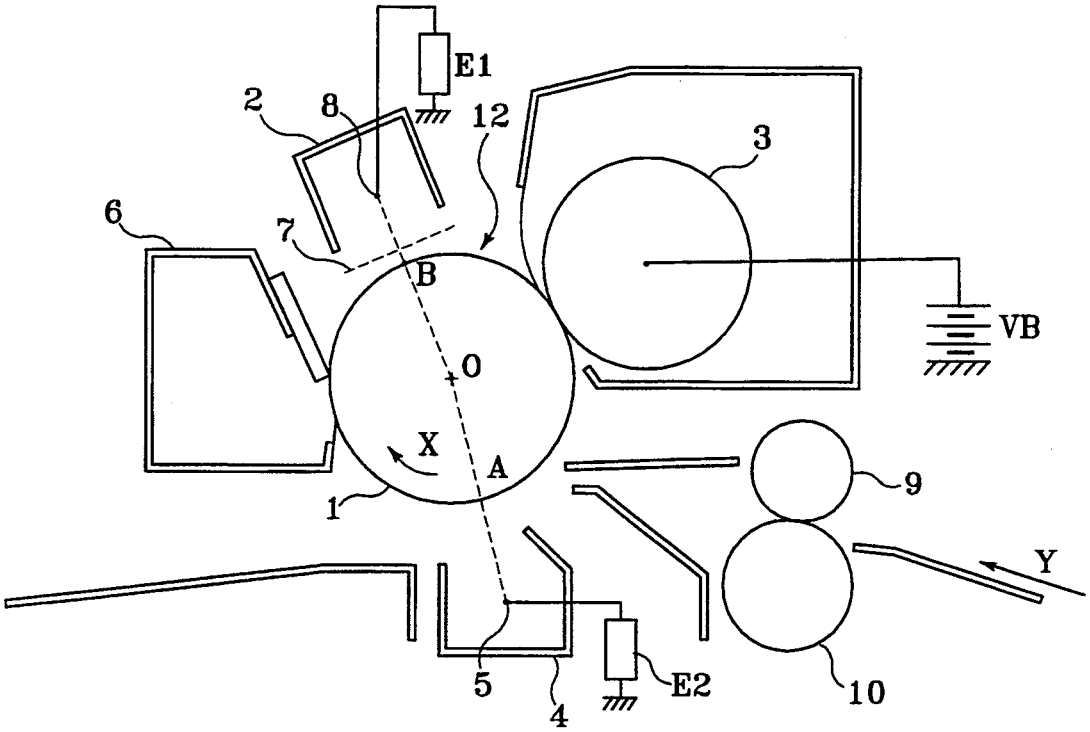
FIG. 6 is a view in section schematically showing a second embodiment of the invention.
Figure 7:
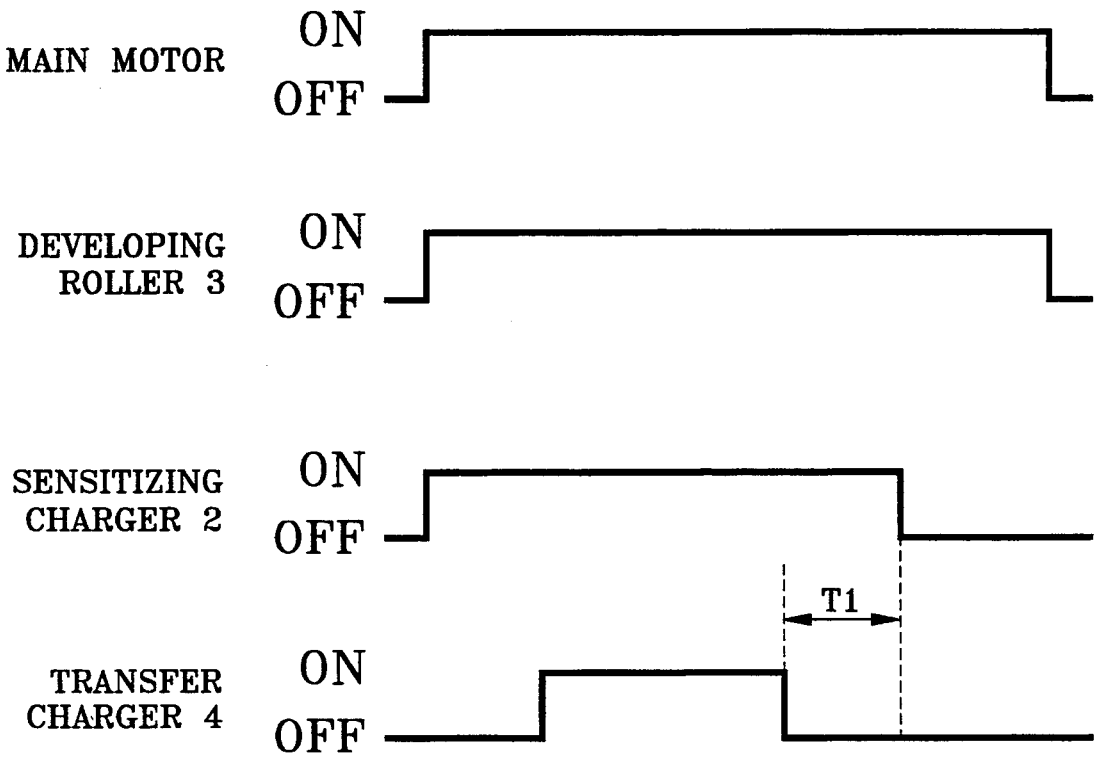
FIG. 7 is a timing chart showing the timing with which the sensitizing and transfer chargers of the second embodiment are controlled.

FIG. 6 is a sectional view schematically showing another laser beam printer as a second embodiment, which corresponds to the first embodiment with the eraser lamp 11 omitted therefrom. With reference to the timing chart of FIG. 7, the second embodiment is also so adapted that the transfer charger 4 is turned off upon the image area rear end moving past the position (point A) of this charger 4, followed by turning off of the sensitizing charger 2 a period of time T1 thereafter.

Stated more specifically, the photosensitive drum 1 has its surface potential lowered by the corona discharge from the transfer charger 4 when the toner image moves past the position (point A) of the charger 4, whereas the portion having the lowered surface potential is charged again at the position (point B) of the sensitizing charger 2 and reaches the position of the developing roller 3 while retaining a high surface potential. This obviates deposition of extraneous toner on the drum 1.

On the other hand, the nonimage area of the photosensitive drum 1 moving past the position (point A) of the transfer charger 4 after the charger 4 has been turned off reaches the position (point B) of the sensitizing charger 2 the period of time T1 after moving past the point A while retaining a high potential. However, the sensitizing charger 2 is turned off before the nonimage area reaches the point B, so that the drum 1 is not acted on by corona discharge. Furthermore, the nonimage area is not charged to the opposite polarity by the transfer charger 4 and therefore retains the high surface potential. Thus, the nonimage area is still maintained at the high potential even when reaching the position of the developing roller 3 with the rotation of the drum 1, consequently permitting no deposition of the toner on the area. The main motor is thereafter turned off at a predetermined time to stop the rotation of the drum 1.

We conducted experiments to compare the control method of the present invention with the conventional control method to check the amount of ozone produced and occurrence of faults in images. Table 1 shows the relationship of the operating time of the sensitizing charger 2 with the amount of ozone produced and occurrence of faults in the image, as established by performing one image forming cycle by the conventional control method and the control method of the invention. The table reveals that as compared with the conventional method, the present method achieved about 30% reduction in the operating time of the charger 2 and about 30% decrease in the amount of ozone produced.

TABLE 1

| | Operating time (sec) | $O_3$ concentration (ppm) | Faults in image |
|---|---|---|---|
| Conventional | 23.5 | 11.7 | Occurred |
| Invention | 16.3 | 8.0 | None |

Although the present invention has been described above with reference to the embodiments which are laser beam printers, the invention can be embodied also as LED printers, liquid crystal printers, digital copying machines and analog copying machines wherein the reversal developing process is used.

According to the invention, the sensitizing means is turned off before the image bearing member is stopped and is therefore operated for a shortened period of time to diminish ozone and nitrogen oxide emissions due to the corona discharge of the sensitizing means. This decreases the reduction in the sensitivity of the photosensitive member due to the interaction of ozone and nitrogen oxides with paper particles or the like to preclude faults in images.

The transfer means is turned off upon the rear end of the electrostatic latent image on the image bearing member moving past the transfer means, and the sensitizing means is thereafter turned off upon the image area rear end moving past the sensitizing means, so that the surface of the image bearing member which has its surface potential reduced by moving past the transfer means before the transfer means is turned off can be charged again to a high potential by the sensitizing means. Waste of toner is therefore precluded.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:
a drivingly rotatable image bearing member;
means for charging the image bearing member to a predetermined polarity;
means for forming an electrostatic latent image on the charged image bearing member;
means for developing the electrostatic latent image with toner by reversal development;
charge erasing means for erasing a charge on the image bearing member; and
control means for turning off the charge erasing means after the rear end of the image area of said image bearing member where the latent image is formed has moved past the charge erasing means, subsequently turning off the charging means after the rear end of the image area has moved past the charging means and stopping the rotation of the image bearing member a predetermined period of time after the charging means is turned off.

2. The image forming apparatus according to claim 1, wherein said charge erasing means is a transfer charger for imparting to the image bearing member a charge having a polarity opposite to said predetermined polarity to transfer the toner image from the image bearing member onto a sheet.

3. The image forming apparatus according to claim 2, wherein said transfer charger is a corona discharger.

4. The image forming apparatus according to claim 1, wherein said charging means is a corona discharger.

5. The image forming apparatus according to claim 1, wherein said charge erasing means is a eraser lamp for irradiating with light the image bearing member to erase charges thereon.

6. In an image forming apparatus including a drivingly rotatable image bearing member, first charging means for charging the image bearing member to a first polarity, means for forming an electrostatic latent image on the charged image bearing member, means for developing the electrostatic latent image with toner by reversal development, and second charging means for imparting to the image bearing member a charge having a second polarity opposite to the first polarity to transfer the toner image from the image bearing member onto a sheet, a method of controlling the apparatus comprising the steps of:

turning off the second charging means after the rear end of the image area of said image bearing member where the latent image is formed has moved past the second charging means, subsequently turning off the first charging means after the rear end of the image area has moved past the first charging means; and stopping the rotation of the image bearing member a predetermined period of time after the first charging means is turned off.

7. In an image forming apparatus including a drivingly rotatable image bearing member, first charging means for charging the image bearing member to a first polarity, means for forming an electrostatic latent image on the charged image bearing member, means for developing the electrostatic latent image with toner by reversal development, second charging means for imparting to the image bearing member a charge having a second polarity opposite to the first polarity to transfer the toner image from the image bearing member onto a sheet, and erasing means for irradiating with light the image bearing member to erase charges thereon, a method of controlling the apparatus comprising the steps of:

turning off the second charging means after the rear end of the image area of said image bearing member where the latent image is formed has moved past the second charging means, turning off the erasing means after the rear end of the image area has moved past the erasing means;

subsequently turning off the first charging means after the rear end of the image area has moved past the first charging means; and stopping the rotation of the image bearing member a predetermined period of time after the first charging means is turned off.

8. An image forming apparatus comprising:

a drivingly rotatable image bearing member;

means for charging the image bearing member to a first polarity;

means for forming an electrostatic latent image on the charged image bearing member;

means for developing the electrostatic latent image with toner by reversal development;

transfer means for imparting to the image bearing member a charge having a second polarity opposite to the first polarity to transfer the toner image from the image bearing member onto a sheet; and control means for controlling the charging means and the transfer means so as to turn off the transfer means after the rear end of the image area of the image bearing member where the latent image is formed has moved past the transfer means, and subsequently to turn off the charging means when a predetermined time period has elapsed from a time when the transfer means has been turned off, the predetermined time period being a time required for a portion of the image bearing member to move from a position opposed to the transfer means to a position opposed to the charging means.

* * * * *